US007619569B2

(12) United States Patent
Wu et al.

(10) Patent No.: US 7,619,569 B2
(45) Date of Patent: Nov. 17, 2009

(54) MULTI-BAND ANTENNA

(75) Inventors: Hsin-Tsung Wu, Taipei Hsien (TW); Kai Shih, Taipei Hsien (TW); Yu-Yuan Wu, Taipei Hsien (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 338 days.

(21) Appl. No.: 11/838,439

(22) Filed: Aug. 14, 2007

(65) Prior Publication Data

US 2009/0046014 A1 Feb. 19, 2009

(51) Int. Cl.
*H01Q 9/04* (2006.01)

(52) U.S. Cl. ..... 343/700 MS; 343/702; 343/767; 343/846; 343/895

(58) Field of Classification Search ..... 343/700 MS, 343/702, 767, 846, 850, 861, 895
See application file for complete search history.

(56) References Cited

U.S. PATENT DOCUMENTS 7,161,541 B2 * 1/2007 Chen ..... 343/700 MS
7,388,543 B2 * 6/2008 Vance ..... 343/700 MS
7,564,411 B2 * 7/2009 Piisila et al. ..... 343/702
2009/0002243 A1 * 1/2009 Dahlstrom et al. ..... 343/702

* cited by examiner

*Primary Examiner*—Douglas W Owens
*Assistant Examiner*—Chuc D Tran
(74) *Attorney, Agent, or Firm*—WPAT, P.C.; Anthony King

(57) ABSTRACT

A multi-band antenna has a first radiating conductor defining a first side connected to a feeding conductor and a short portion, and a second side opposite to the first side and connected to a second radiating conductor, a third radiating conductor and a fourth radiating conductor. The second radiating conductor is arranged between the third radiating conductor and the fourth radiating conductor. The length of the first radiating conductor and the second radiating conductor resonates at a first frequency range and a second frequency range which is double frequency higher than the first frequency range. The length of the first radiating conductor and the third radiating conductor resonates at a third frequency range which is higher than and close to the second frequency range. The dimension of the fourth radiating conductor has an effect on antenna characteristics in the third frequency range.

11 Claims, 4 Drawing Sheets

MULTI-BAND ANTENNA

BACKGROUND OF THE INVENTION

1. Field of the Invention

The invention relates to the field of antenna. More specifically, a multi-band antenna operates at various wireless communication bands.

2. The Related Art

A portable communication device has an antenna that supports wireless communication in multiple bands, such as global system for mobile communications (GSM). Wireless communication bands include global system for mobile communications (GSM) band about 850 mega-hertz (MHz), extended global system for mobile communications (EGSM) band about 900 MHz, digital cellular system (DCS) band about 1800 MHz and personal conferencing specification (PCS) band about 1900 MHz.

Many different types of antennas for the portable communication device are used, including helix, monopole, inverted-F, dipole, patch, loop and retractable antennas. Helix antenna and retractable antenna are typically installed outside the portable communication device. Inverted-F antenna, monopole antenna, patch antenna, loop antenna and dipole antenna are typically embedded inside the portable communication device case or housing.

Generally, embedded antennas are preferred over external antennas for the portable communication device owing to mechanical and ergonomic reasons. Embedded antennas are protected by the portable communication device case or housing and therefore tend to be more durable than external antennas. Therefore, embedded antenna capable of operating at various wireless communication bands such as GSM band, EGSM band, DCS band and PCS band is an essential component for the portable wireless communication device.

SUMMARY OF THE INVENTION

An object of the present invention is to provide a multi-band antenna having a first radiating conductor, a second radiating conductor, a third radiating conductor, a fourth radiating conductor, a fifth radiating conductor, a feeding conductor and a short conductor. The first radiating conductor defines a first side connected to the feeding conductor and the short conductor, and a second side opposite to the first side and connected to the second radiating conductor, the third radiating conductor and the fourth radiating conductor. The second radiating conductor is arranged between the third radiating conductor and the fourth radiating conductor.

The length of the first radiating conductor and the second radiating conductor resonates at a first frequency range and a second frequency range which is double frequency higher than the first frequency range. The length of the first radiating conductor and the third radiating conductor resonates at a third frequency range higher than and close to the second frequency range.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Structures of the multi-band antenna described herein are sized and shaped to tune the multi-band antenna for operation in wireless telecommunication bands. In an embodiment of the invention described in detail below, the multi-band antenna has structure which is primarily associated with operating bands covering GSM band, EGSM band, DCS band and PCS band.

Figure 1:
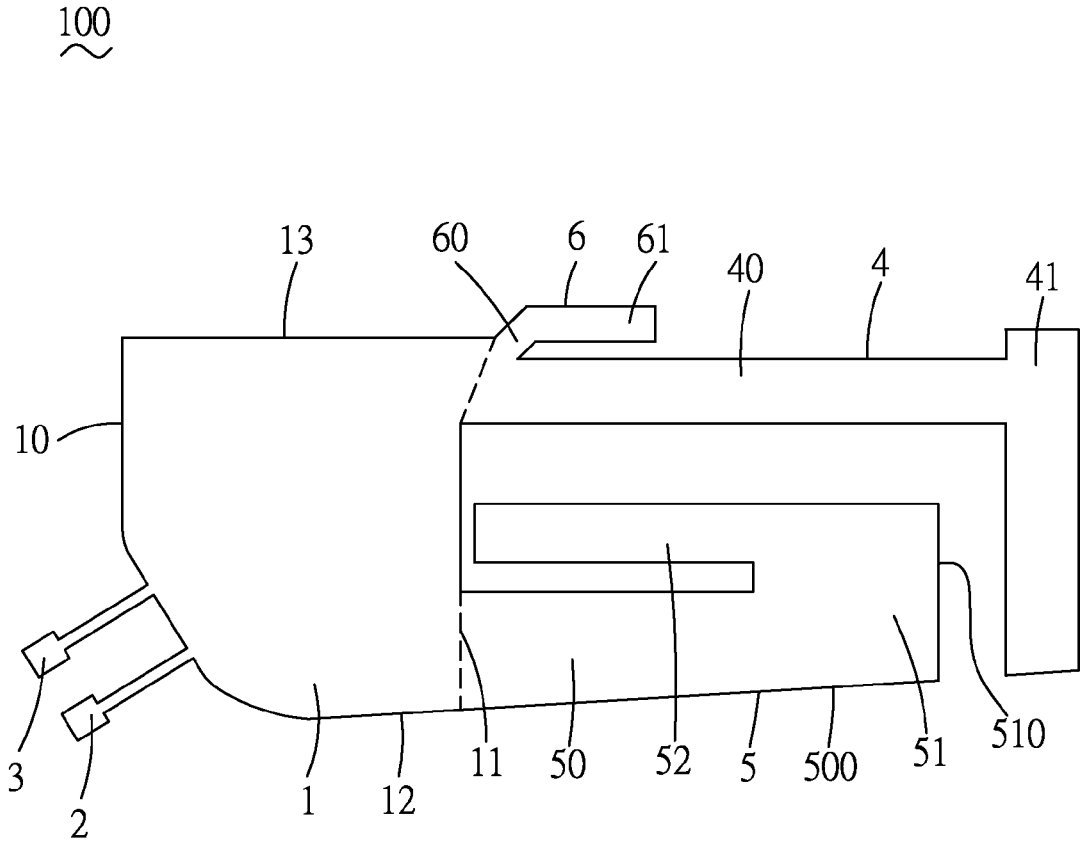
FIG. 1 is a planar view of a preferred embodiment of a multi-band band antenna according to the present invention.

Please refer to FIG. 1. A preferred embodiment of the multi-band antenna 100 according to the present invention is shown. The multi-band antenna 100 has a first radiating conductor 1, a feeding conductor 2, a short conductor 3, a second radiating conductor 4, a third radiating conductor 5 and a fourth radiating conductor 6.

The first radiating conductor 1 defines a first side 10, a second side 11 opposite to the first side 10, a third side 12 and a fourth side 13 opposite to the third side 12. The feeding conductor 2 and the short conductor 3 connect the first side 10 of the first radiating conductor 1, which are arranged close to the third side 12 of the first radiating conductor 1. The feeding conductor 2 is arranged close to the short conductor 3. The second radiating conductor 4, the third radiating conductor 5 and the fourth radiating conductor 6 connect the second side 11 of the first radiating conductor 1. The second radiating conductor 4 is arranged between the third radiating conductor 5 and the fourth radiating conductor 6.

The second radiating conductor 4 has a first portion 40 defining opposite ends and a second portion 41 defining opposite ends. In this case, one end of the first portion 40 of the second radiating conductor 4 connects the second side 11 of the first radiating conductor 1, which is close the fourth side 13 of the first radiating conductor 1. The other end of the first portion 40 connects vicinity of one end of the second portion 41 to form an angle between the first portion 40 and the second portion 41. The other end of the second portion 41 is at the same level with the third side 12 of the first radiating conductor 1. In this case, the second radiating conductor 4 is formed as a L-shape.

The third radiating conductor 5 has a third portion 50 defining a first outer side 500, a fourth portion 51 defining an second outer side 510 and a fifth portion 52. The third portion 50 of the third radiating conductor 5 connects the second side 11 of the first radiating conductor 1. In this case, the first outer side 500 of the third portion 50 of the third radiating conductor 5 is at the same level with the third side 12 of the first radiating conductor 1.

The fourth portion 51 connects the third portion 50 and the fifth portion 52. In this case, the fourth portion 51 of the third radiating conductor 5 is spaced from the second portion 41 of the second radiating conductor 4, the second outer side 510 of the fourth portion 51 faces the second portion 41 of the second radiating conductor 4. The fifth portion 52 of the third radiating conductor 5 is arranged between the third portion 50 of the third radiating conductor 5 and the first portion 40 of the second radiating conductor 4. In this case, the third radiating conductor 5 is formed as an U-shape.

The fourth radiating conductor 6 has a sixth portion 60 and a seventh portion 61. In this case, the sixth portion 60 of the fourth radiating conductor 6 connects the corner of the first radiating conductor 1 which is surrounded by the second side 11 and the fourth side 13. The sixth portion 60 of the fourth radiating conductor 6 also connects the first portion 40 of the second radiating conductor 4. The seventh portion 61 connects the sixth portion 60 and spaces from the first portion 40 of the second radiating conductor 4. In this case, the seventh portion 61 is arranged at the same direction in relation to the first portion 40 of the second radiating conductor 4.

In this case, antenna characteristic of the first radiating conductor 1 and the second radiating conductor 4 is similar to an inverted-F antenna. The length of the first radiating conductor 1 and the second radiating conductor 4 resonate at a first frequency range covering GSM band and EGSM band and a second frequency range covering DCS band. In this case, the first radiating conductor 1 and the second radiating conductor 4 obtain a quarter wavelength corresponding to the first frequency range.

Furthermore, antenna characteristic of the first radiating conductor 1 and the third radiating conductor 5 is similar to a loop antenna. The length of the first radiating conductor 1 and the third radiating conductor 5 resonate at a third frequency range covering PCS band. In this case, the first radiating conductor 1 and the third radiating conductor 5 obtain a half wavelength corresponding to the third frequency range.

The size, the shape and the length of the second radiating conductor 4 have a most pronounced effect on antenna characteristics in the first frequency range and the second frequency range as well as antenna gain and coving scope of the first frequency range and the second frequency range. Also, the size, the shape and the length of the third radiating conductor 5 have a most pronounced effect on antenna characteristics in the third frequency range. In this case, the size, the shape and the length of the fourth radiating conductor 6 have a minor effect on antenna characteristics in the third frequency range.

Figure 2:
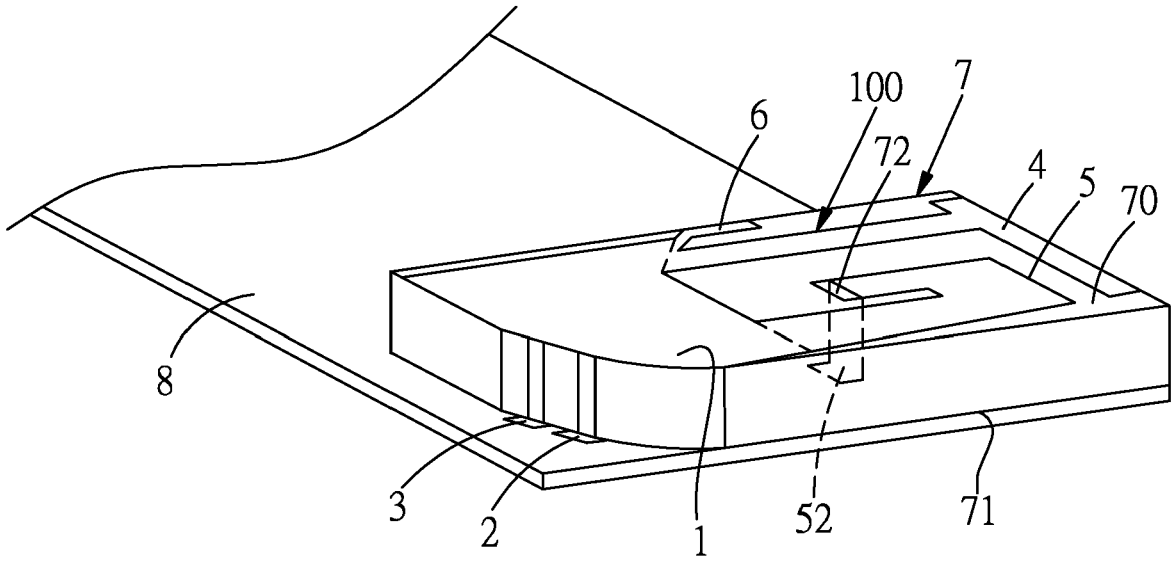
FIG. 2 shows the multi-band antenna being supported by a dielectric element and connected to a printed circuit board.

Please refer to FIG. 2. The multi-band antenna 100 is supported by a dielectric element 7 and connects to a printed circuit board 8 which is received in a mobile phone (not shown in figures). The mobile phone generally has a first portion and a second portion relatively moved to the first portion, such as a folding type mobile phone, a rotating type mobile and a sliding type mobile phone. The multi-band antenna 100 is received in the first portion or the second portion of the mobile phone. The first portion covers one surface of the second portion when the mobile phone is in the closed position for standby purpose. The first portion relatively moves to the second portion to expose the surface of the second portion to outside when the mobile phone in the opened position for telecommunication purpose.

In this case, the multi-band antenna 100 and the dielectric element 7 can be received in the first electric portion or the second electric portion of the mobile phone. In this case, the dielectric element 7 has a top surface 70, a bottom surface 71 and a through hole 72 opened through the top surface 70 and the bottom surface 71. The first radiating conductor 1, the second radiating conductor 4, the third radiating conductor 5 and the fourth radiating conductor 6 are arranged on the top surface 70 of the dielectric element 7. The bottom surface 71 of the dielectric element 7 is attached on the printed circuit board 8.

The feeding conductor 2 is bent towards the printed circuit board 8 and electronically connected to a signal pad (not shown in figures) for transmission of the signal between multi-band antenna 100 and a signal processor (not shown in figures) electronically connected to the signal pad. The short conductor 3 is bent towards the printed circuit board 8 and electronically connected to a ground pad for electronically coupling ground portion of the printed circuit board 8. Part of the fifth portion 52 of the third radiating conductor 5 is bent towards the printed circuit board 8 through the through hole 72 of the dielectric element 7 and electronically connected to the ground pad for electronically coupling ground portion of the printed circuit board 8.

Figure 3:
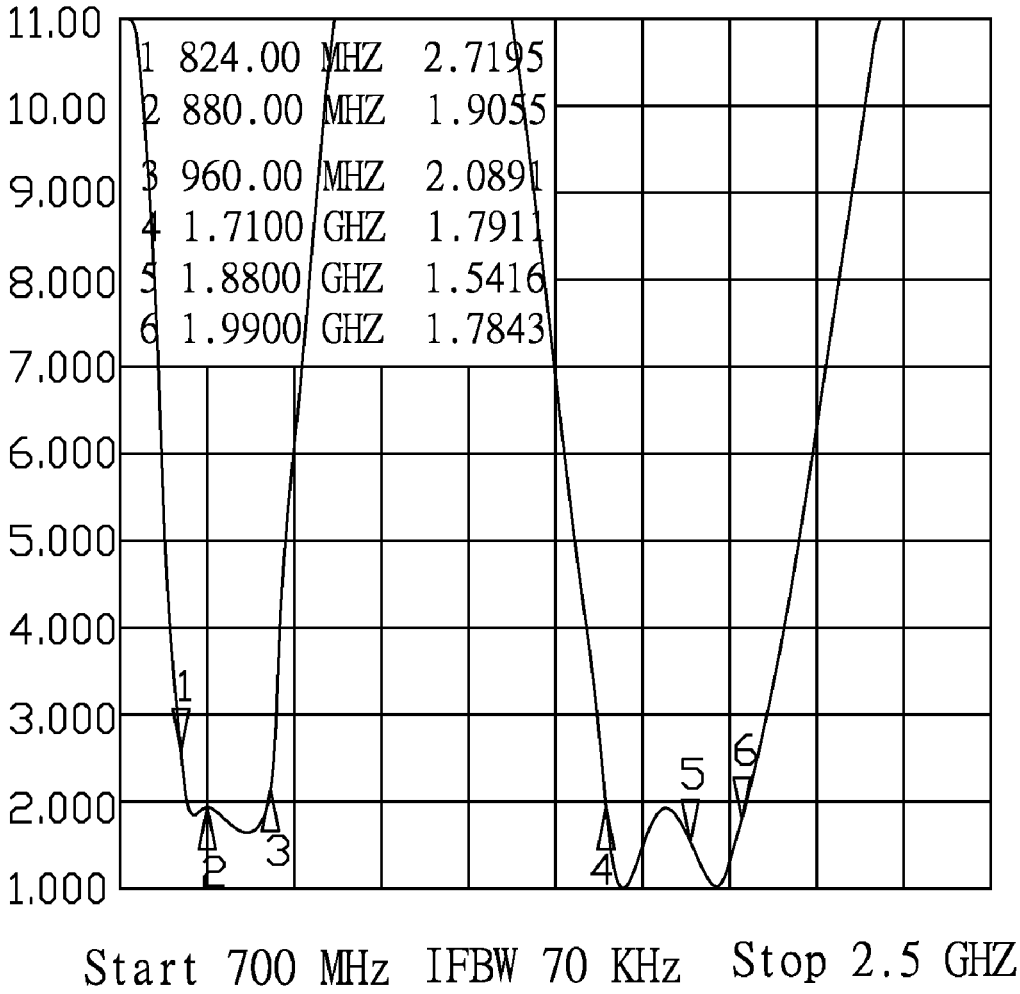
FIG. 3 shows a Voltage Standing Wave Ratio (VSWR) test chart of the multi-band antenna when the multi-band antenna is configured in the mobile phone, and the mobile phone is in the opened position.

Please refer to FIG. 3, which shows a Voltage Standing Wave Ratio (VSWR) test chart of the multi-band antenna 100 when the multi-band antenna 100 is configured in the mobile phone, and the mobile phone is in the closed position. When the multi-band antenna 100 operates at 824 MHz, the VSWR value is 2.7195. When the multi-band antenna 100 operates at 880 MHz, the VSWR value is 1.9055. The VSWR value is 2.0891, when the multi-band antenna 100 operates at 960 MHz. The VSWR value is 1.7911, when the multi-band antenna 100 operates at 1710 MHz. The VSWR value is 1.5416, when the multi-band antenna 100 operates at 1880 MHz. The VSWR value is 1.7843, when the multi-band antenna 100 operates at 1990 MHz.

Figure 4:
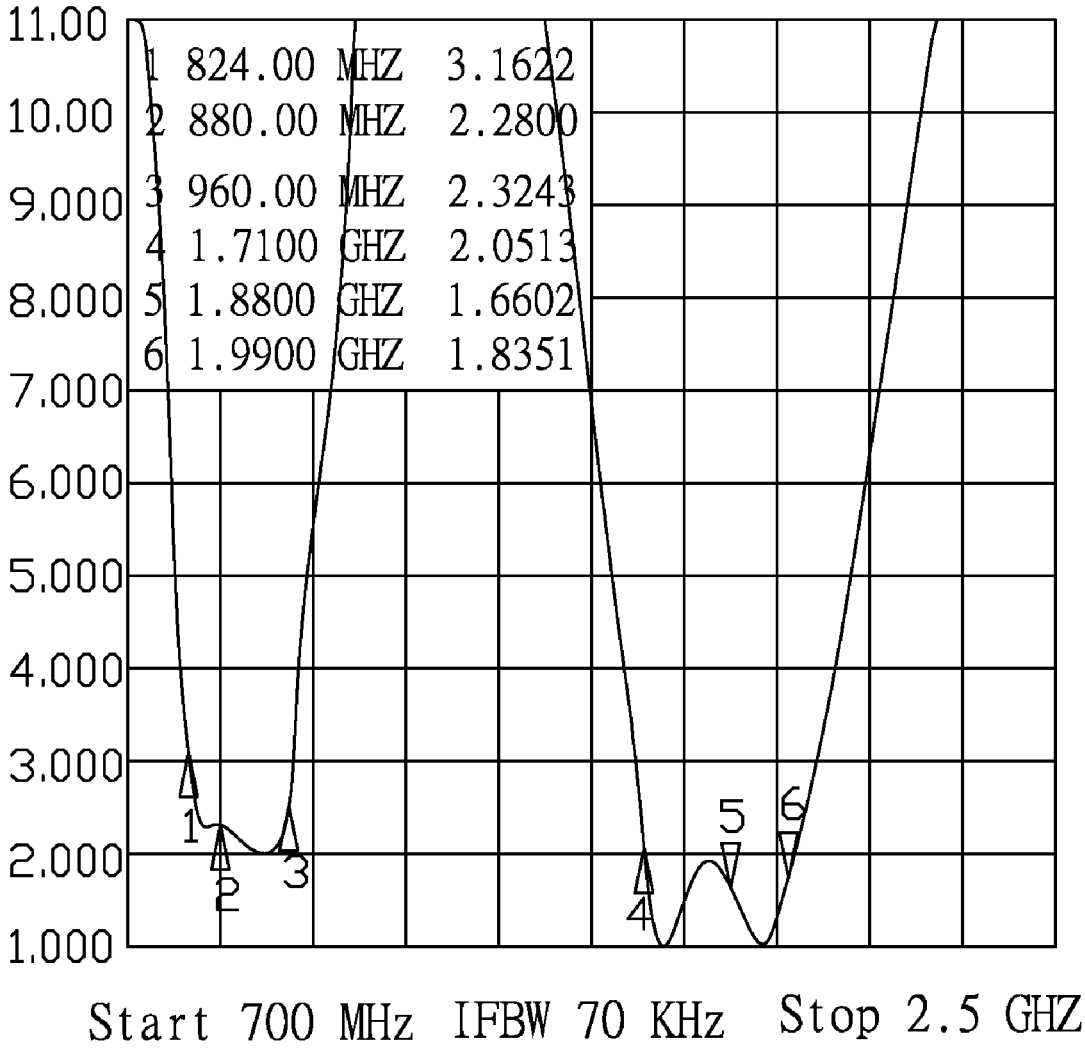
FIG. 4 shows a Voltage Standing Wave Ratio (VSWR) test chart of the multi-band antenna when the multi-band antenna is configured in the mobile phone, and the mobile phone is in the closed position.

Please refer to FIG. 4, which shows a Voltage Standing Wave Ratio (VSWR) test chart of the multi-band antenna 100 when the multi-band antenna 100 is configured in the mobile phone, and the mobile phone is in the opened position. When the multi-band antenna 100 operates at 824 MHz, the VSWR value is 3.1622. When the multi-band antenna 100 operates at 880 MHz, the VSWR value is 2.28. The VSWR value is 2.3243, when the multi-band antenna 100 operates at 960 MHz. The VSWR value is 2.0513, when the multi-band antenna 100 operates at 1710 MHz. The VSWR value is 1.6602, when the multi-band antenna 100 operates at 1880 MHz. The VSWR value is 1.8351, when the multi-band antenna 100 operates at 1990 MHz.

As described in FIG. 3 and FIG. 4, VSWR value of the multi-band antenna 100 which is configured in the mobile phone and the mobile phone is in the closed position is similar to VSWR value of the multi-band antenna 100 which is configured in the mobile phone and the mobile phone is in the opened position. Therefore, the multi-band antenna 100 has stable and preferred antenna characteristics both in standby of the mobile phone and in telecommunication of the mobile phone.

Therefore, the multi-band antenna 100 obtains three frequency range covering 850 MHz, 900 MHz, 1800 MHz and 1900 MHz corresponding to GSM band, EGSM band, DCS band and PCS band in wireless telecommunication. Due to the multi-band antenna 100 obtains stable and preferred VSWR value both in standby of the mobile phone and in telecommunication of the mobile phone, the mobile has a preferred quality of wireless telecommunication.

Furthermore, the present invention is not limited to the embodiments described above; various additions, alterations and the like may be made within the scope of the present invention by a person skilled in the art. For example, respective embodiments may be appropriately combined.

What is claimed is:

1. A multi-band antenna, comprising:

a first radiating conductor defining a first side and a second side opposite to said first side;

a feeding conductor connected to said first side of said first radiating conductor;

a short conductor arranged close to said feeding conductor and connected to said first side of said first radiating conductor; and a second radiating conductor having a first portion and a second portion, one end of said first portion connecting said second side of said first radiating conductor, the other end of said first portion connecting vicinity of one end of said second portion to form an angle between said first portion and said second portion;

a third radiating conductor having a third portion, a fourth portion and a fifth portion, said third portion connecting said second side of said first radiating conductor, said fourth portion connecting said third portion and said fifth portion, said fifth portion arranged between said third portion and said first portion of said second radiating conductor; and a fourth radiating conductor connected to said second side of said first radiating conductor, said second radiating conductor arranged between said third radiating conductor and said fourth radiating conductor.

2. The multi-band antenna as claimed in claim 1, wherein said second radiating conductor is formed as a L-shape.

3. The multi-band antenna as claimed in claim 1, wherein said third radiating conductor is formed as an U-shape.

4. The multi-band antenna as claimed in claim 1, wherein said fourth radiating conductor has a sixth portion and a seventh portion, said sixth portion is connected to said second side of said first radiating conductor, said seventh portion is connected to said sixth portion and arranged at the same direction in relation to said first portion of said second radiating conductor.

5. The multi-band antenna as claimed in claim 4, wherein said first radiating conductor defines a third side and a fourth side opposite to said third side, the other end of said second portion of said second radiating conductor and an outer side of said third portion of said third radiating conductor are at the same level with said third side of said first radiating conductor.

6. A multi-band antenna, comprising:

a ground portion;

a first radiating conductor defining a first side and a second side opposite to said first side;

a feeding conductor connected to said first side of said first radiating conductor;

a short conductor arranged close to said feeding conductor and connected to said first side of said first radiating conductor and said ground portion;

a second radiating conductor defining two ends, one end of said second radiating conductor connected to said second side of said first radiating conductor, the length of said first radiating conductor and said second radiating conductor resonated at a first frequency range and a second frequency range higher than said first frequency range;

a third radiating conductor defining two ends, one end of said third radiating conductor connected to said second side of said first radiating conductor and the other end of said third radiating conductor connected to said ground portion, the length of said first radiating conductor and said third radiating conductor resonated at a third frequency range which is higher than and close to said second frequency range; and a fourth radiating conductor connected to said second side of said first radiating conductor, wherein the dimension of said fourth radiating conductor is tunable for adjusting antenna characteristics in said third frequency range.

7. The multi-band antenna as claimed in claim 6, wherein said second radiating conductor is arranged between said third radiating conductor and said fourth radiating conductor.

8. The multi-band antenna as claimed in claim 7, wherein said first radiating conductor defines a third side and a fourth side opposite to said third side, said feeding conductor is arranged close to said third side of said first radiating conductor.

9. The multi-band antenna as claimed in claim 8, wherein said second radiating conductor has a first portion defining opposite ends and a second portion defining opposite ends, one end of said first portion is connected to said first radiating conductor, the other end of said first portion is connected to vicinity of one end of said second portion, the other end of said second portion is at the same level with said third side of said first radiating conductor.

10. The multi-band antenna as claimed in claim 9, wherein said third radiating conductor has a third portion connected to said first radiating conductor and defining a first outer side at the same level with said third side of said first radiating conductor, a fourth portion connected to said third portion and defining a second outer side facing said second portion of said second radiating conductor, and a fifth portion connected to said fourth portion and said ground portion and arranged between said first portion of said second radiating conductor and said third portion.

11. The multi-band antenna as claimed in claim 10, wherein said fourth radiating conductor has a sixth portion and a seventh portion, said sixth portion is connected to the corner of said first radiating conductor which is formed by said second side and said fourth side of said first radiating conductor, said seventh portion is connected to said sixth portion and arranged at the same direction in relation to said first portion of said second radiating conductor.

* * * * *